US007922060B2

(12) United States Patent
Kishi et al.

(10) Patent No.: US 7,922,060 B2
(45) Date of Patent: Apr. 12, 2011

(54) STAPLER

(75) Inventors: Kazuhiko Kishi, Tokyo (JP); Toshio Shimizu, Tokyo (JP); Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 276 days.

(21) Appl. No.: 10/585,736

(22) PCT Filed: Jan. 12, 2005

(86) PCT No.: PCT/JP2005/000245

§ 371 (c)(1),
(2), (4) Date: Jul. 12, 2006

(87) PCT Pub. No.: WO2005/068135

PCT Pub. Date: Jul. 28, 2005

(65) Prior Publication Data

US 2008/0135599 A1 Jun. 12, 2008

(30) Foreign Application Priority Data

Jan. 13, 2004 (JP) ..... P.2004-005239
Jan. 13, 2004 (JP) ..... P.2004-005240

(51) Int. Cl.
*B25C 5/02* (2006.01)

(52) U.S. Cl. ..... 227/155; 227/79; 227/120; 227/131

(58) Field of Classification Search ..... 227/79, 227/155

See application file for complete search history.

(56) References Cited

U.S. PATENT DOCUMENTS 3,034,382 A * 5/1962 Hazel ..... 29/566
3,414,024 A * 12/1968 Anderson et al. ..... 140/1
4,087,034 A * 5/1978 Kikkawa et al. ..... 227/90
4,165,557 A * 8/1979 Taguchi et al. ..... 29/566.3
4,378,085 A * 3/1983 McVeigh ..... 227/79
4,844,319 A * 7/1989 Kurosawa ..... 227/79
5,799,935 A 9/1998 Yamanushi et al.

(Continued)

FOREIGN PATENT DOCUMENTS

DE 196 07 296 A1 8/1987

(Continued)

*Primary Examiner* — Rinaldi I. Rada
*Assistant Examiner* — Lindsay Low
(74) *Attorney, Agent, or Firm* — Morgan, Lewis & Bockius LLP

(57) ABSTRACT

A staple leg cutting mechanism 5 is composed of a fixed cutter 6 interposed between staple legs S1 penetrated through binding sheets and a pair of movable cutters 7 disposed movable from the outside of the staple legs S1 to the inside thereof, and a clincher mechanism 10 is composed of a pair of movable clinchers 11 respectively disposed on the lower surface side of their associated movable cutters 7, whereby the staple legs S1 penetrated through the binding sheets are formed in an inwardly curved manner by the movable clinchers 11 and are then guided into and between the movable cutters 7 and fixed cutter 6, the movable cutters 7 are moved from the outside of the staple legs S1 to the inside thereof to thereby cut the leading end portions of the staple legs S1, and the staple legs S1 are bent along the binding sheets by the movable clinchers 11.

2 Claims, 14 Drawing Sheets

U.S. PATENT DOCUMENTS

| | | | | |
|---|---|---|---|---|
| 5,862,971 | A | 1/1999 | Ebner | |
| 6,036,074 | A * | 3/2000 | Manabe | 227/155 |
| 6,250,531 | B1 * | 6/2001 | Yagi | 227/79 |
| 6,286,744 | B1 * | 9/2001 | Crowley | 227/69 |
| 6,935,547 | B2 * | 8/2005 | Mochizuki | 227/131 |
| 6,942,136 | B2 * | 9/2005 | Tsai | 227/155 |
| 6,981,626 | B1 * | 1/2006 | Tsai | 227/79 |
| 7,021,515 | B2 * | 4/2006 | Elonsson et al. | 227/134 |
| 7,108,165 | B2 * | 9/2006 | Tsai | 227/155 |
| 2003/0000992 | A1 * | 1/2003 | Borjesson et al. | 227/155 |
| 2006/0163311 | A1 * | 7/2006 | Tsai | 227/155 |
| 2006/0266789 | A1 * | 11/2006 | Tsai | 227/155 |
| 2007/0034665 | A1 * | 2/2007 | Shimizu et al. | 227/155 |

FOREIGN PATENT DOCUMENTS

| | | | |
|---|---|---|---|
| EP | 1 160 063 | A1 | 12/2001 |
| EP | 1 166 981 | A1 | 1/2002 |
| JP | 56-7845 | | 2/1981 |
| JP | 57-102301 | | 6/1982 |
| JP | 2-21922 | | 5/1990 |
| JP | 3-25930 | | 6/1991 |
| JP | 10-128683 | | 5/1998 |
| JP | 2000-127062 | | 5/2000 |
| JP | 2002-1678 | | 1/2002 |
| JP | 2003-89102 | | 3/2003 |
| WO | WO 01/62444 | A2 | 8/2001 |

* cited by examiner

STAPLER

TECHNICAL FIELD

The present invention relates to a stapler provided with: a movable clincher mechanism which strikes out a U-shaped staple toward binding sheets and then clinches the legs of the staple penetrated through the back surface side of the binding sheets along the back surface of the binding sheets; and a staple leg cutting mechanism which cuts the staple legs staple penetrated through the binding sheets to the back surface side thereof according to the thickness of the binding sheets and then bends the thus-cut staple legs along the back surfaces of the binding sheets.

BACKGROUND ART

Conventionally, in an electric stapler or the like which strikes a staple toward binding sheets to thereby bind the binding sheets together in a bundle by the staple, a U-shaped staple including a pair of leg portions extending in the same direction is struck out toward binding sheets from the front surfaces of the binding sheets by a striking mechanism, and the pair of leg portions of the staple penetrated through the binding sheets are bent or clinched along the back surfaces of the binding sheets by a clincher mechanism. For example, an ordinary clincher mechanism used in a conventional electric stapler as disclosed in JP-A-10-128683 is composed of a pair of movable clinchers which are rotatably disposed opposed to the respective staple legs penetrated through the back surface side of the binding sheets. In this clincher mechanism, after the penetration of the most portions of the staple legs of the staple struck out from a striking mechanism through the binding sheets is completed, the movable clinchers are operated and rotated to bend the staple legs along the back surfaces of the binding sheets, thereby binding the binding sheets by the staple.

The pair of movable clinchers are disposed opposed to the striking position of the staple and are rotatably supported on their respective pivots between two clincher guide plates disposed side by side in the back-and-forth direction, and the clincher surfaces of the movable clinchers are disposed so as to be engageable with the respective legs of the staple penetrated through the binding sheets. To operate and rotate the movable clinchers, there is provided a drive lever the central portion of which is rotatably supported on a frame. When the rear portion of the drive lever is engaged with a drive cam which can be rotated by a motor used to drive the stapler, the front end portion of the drive lever can be operated and oscillated in the upward and downward directions; and when the front end portion of the drive lever is engaged with part of the movable clincher and the drive lever is then operated or oscillated, the movable clincher can be rotated. When a roller mounted on the rear end of the drive lever is contacted with the cam surface of the drive cam and the drive cam is rotated, the rear end of the drive lever is operated or oscillated in the vertical direction and thus the front end portion of the drive lever is oscillated in the vertical direction about the rotation support shaft of the drive lever, thereby causing the drive lever to press down part of the movable clincher. As a result, the movable clincher is rotated about its support shaft and thus the clincher surface of the movable clincher is engaged with its associated staple leg, so that the movable clincher clinches or bends the staple leg portion along the back surfaces of the binding sheets to thereby bind together the binding sheets.

In an ordinary stapler, there are loaded staples of one kind having a leg length corresponding to the maximum thickness of binding sheets to be bound by the stapler, and these staples are used to bind binding sheets which range in thickness from the smallest to the maximum. For this reason, when binding sheets having a small thickness are bound, the length of the staple legs to be penetrated through the binding sheets to the back surface thereof is long, thereby causing the occurrence of unfavorable phenomena such as a re-penetration phenomenon in which, when the staple legs are clinched or bent by the clincher mechanism, the leading end portions of the staple legs are penetrated again through the binding sheets and are thereby projected to the front surface side thereof. As means for solving this, there is known a binding method using a so called bypass clinch in which, in order that the staple legs penetrated through the binding sheets to the back surface side thereof can be bent without interfering with each other, the side surfaces of the staple legs are bent while they are disposed so as to adjoin each other. However, in this binding method, it is necessary to form, in the clincher mechanism, a guide structure which is used to guide the staple legs in such a manner that the side surfaces of the staple legs are allowed to adjoin each other, which requires high precision of the parts of the clincher mechanism and the assembling thereof are required of high precision, resulting in the increased cost of the stapler. Further, when binding sheets with the central portions thereof staple fastened are bent half to thereby bind a book, there is required a so called in-line binding method in which the staple legs are disposed on a straight line.

Also, referring to a stapler built into a copying machine and the like, in order to prevent the staple legs from being projected out to the front surface side of the binding sheets when binding the above-mentioned thin binding sheets, there is proposed a stapler including a staple leg cutting mechanism which cuts the leading end portions of the staple legs penetrated through the binding sheet in such a manner that the staple legs projected out to the back surface side of the binding sheets can be made substantially equal in length. (For example, JP-B-02-021922). This staple leg cutting mechanism is composed of a pair of movable clinchers for bending the staple legs penetrated through the binding sheets to the back surface side thereof along the back surfaces of the binding sheets, and a fixed cutter interposed between the pair of movable clinchers, in which the leading end portions of the staple legs penetrated through the binding sheet are cut with movable cutting edges formed in the movable clinchers and fixed cutting edges formed in the fixed cutter. And, in this staple leg cutting mechanism, simultaneously when the staple legs are bent with the movable clinchers, the leading end portions of the staple legs are cut.

And, there is also proposed a staple leg cutting mechanism in which, below a movable clincher which can be engaged with staple legs penetrated through binding sheets and can bend the staple legs along the back surfaces of the binding sheets, there is provided a movable cutting member movable in a direction substantially perpendicular to the penetrating direction of the staple legs and including a first cutting edge engageable with the staple legs penetrated through the binding sheets, and, on a fixed cutting member provided so as to be able to guide the movement of the movable cutting member, there is formed a second cutting edge which cooperates with the first cutting edge of the movable cutting member in cutting the staple legs. (For example, JP-Y-03-025930). In this staple leg cutting mechanism, the staple legs penetrated through the binding sheets are engaged with the first and second cutting edges respectively formed in the movable and fixed cutting members and then the movable cutting member is moved along the fixed cutting member to thereby cut the leading end portions of the staple legs; and, after then, the staple legs are bent along the back surfaces of the binding sheets by a movable clincher mechanism.

DISCLOSURE OF THE INVENTION

Problems to be Solved by the Invention

Here, referring to the operation of the movable clincher, when the movable clincher is rotated by the above-mentioned drive link in its operation stroke range, the clincher surface of the movable clincher is engaged with the staple leg and, in this state, the movable clincher is moved to pressure shape the staple legs along the back surfaces of the binding sheets in such a manner that the staple legs are contacted with the back surfaces of the binding sheets. In the above-mentioned conventional movable clincher operation mechanism disclosed in JP-A-10-128683 publication, the above-mentioned movable clincher is operated and rotated by a drive lever which can be operated and oscillated by a drive cam, and the operation stroke of the drive lever is set in proportion to the rotation stroke of the movable clincher. Therefore, when the oscillation stroke amount of the leading end portion of the drive lever is caused to vary or the range of the operation stroke of the drive lever is shifted due to the accumulated dimension tolerances of the composing parts of the clincher mechanism such as the drive lever and drive cam, the operation stroke of the movable clincher to be operated by the drive lever is caused to vary, so that the final operation position of the clincher surface of the movable clincher cannot be settled in a given range, thereby causing the staple legs to float up from the back surfaces of the binding sheets or causing the leading end portions of the staple legs to be projected out to the front surface side of the binding sheets. This raises a problem that the clinched shape of the staple legs cannot be maintained in a stable state.

Also, in the staple leg cutting mechanism disclosed in JP-B-02-021922 and structured such that the staple legs are cut by the movable clincher and fixed cutter, since the pair of movable clinchers are rotatably supported on their respective pivots and the staple legs are cut between the movable cutting edge of the two movable clinchers and the fixed cutting edge of the fixed cutter, there is required high dimension precision in setting a clearance between the movable and fixed cutting edges, which requires high precision in setting the dimensions of the composing parts of the staple leg cutting mechanism, in working them and in assembling them together. This increases the costs of the composing parts and thus the costs of the products defect and, when the parts are worn, there occur operation failures such as poor cutting or poor clinching. Also, the directions of burrs, which are formed on the end faces of the staple legs after the staple legs are cut by the two kinds of cutting edges, are formed outside the staple legs. Owing to this, when the staple-bound sheets are piled up on top of each other, there is a fear that problems in quality can occur, for example, a problem that there can be left scratch traces on the piled-up sheets due to the burrs formed toward the side surface directions of the staple legs.

Further, in the staple leg cutting mechanism disclosed in JP-Y-03-025930 and structured such that the movable cutting member is provided below the movable clincher and the movable clincher is moved in a direction substantially perpendicular to the penetrating direction of the staple legs to thereby cut the staple legs between the movable cutting member and fixed cutting member, since the movable clincher and movable cutting member must be disposed on the same plane, the portion of the movable clincher to be engaged with the staple leg cannot be formed large. This raises a problem that the clinching shape of the staple leg cannot be bent in a stable manner. Also, the directions of the burrs, which are formed in the cutting end portions of the staple legs when the staple legs are cut, are formed in the side surface directions of the staple legs. Because of this, when staple-bound sheets are piled up on top of each other, there is a fear that a quality problem can occur, for example, scratch traces can be left on the piled-up sheets due to the burrs formed toward the side surface directions of the staple legs.

Means for Solving the Problems

It is an object of the invention to provide a stapler including a movable clincher operation mechanism capable of positively operating movable clinchers in a given range of operation stroke, the movable clinchers being used to bend the legs of a staple along the back surfaces of binding sheets.

In attaining the above object, according to the invention, for use in a stapler structured such that a U-shaped staple is struck out from a striking mechanism part toward binding sheets, the legs of the staple are penetrated through the binding sheets, and the staple legs penetrated through the binding sheets are bent along the back surfaces of the binding sheets by a clincher mechanism disposed on the back surface side of the binding sheets, there is provided a movable clincher operation mechanism, wherein a clincher mechanism is composed of a pair of movable clinchers rotatably disposed opposed to the strike-out position of the staple and a pair of clincher cams rotatably disposed adjacent to their associated movable clinchers, the movable clinchers respectively having clincher pieces disposed engageable with their associated staple legs penetrated through the binding sheets to the back surface side thereof, the clincher cams respectively having arc-shaped cam surfaces engageable with their associated movable clinchers for rotating the movable clinchers, whereby the clincher cams can be driven and rotated through their associated drive links to be operated by a drive mechanism for driving the stapler, and the movable clinchers can be operated and rotated by their associated arc-shaped cam surfaces respectively formed in the clincher cams.

Further, in the above-mentioned movable clincher operation mechanism, preferably, in the cam surface of each of the clincher cams, there may be formed an arc-shaped portion which extends from the center of rotation of the clincher cam and has the same radius thereof so as to prevent the operation piece of the movable clincher from being shifted in position when the clincher cam is rotated more than its given amount.

According to the invention, the clincher mechanism is composed of movable clinchers respectively having clincher pieces disposed engageable with the staple legs penetrated through the binding sheets to the back surface side thereof and rotation cams disposed adjacent to the movable clinchers, while the movable clinchers and rotation cams are respectively rotatably supported; the rotation cams can be driven and rotated through their associated drive links which can be operated and oscillated by the drive mechanism for driving the stapler; and the movable clinchers can be operated and rotated by arc-shaped cam surfaces respectively formed in the rotation cams. That is, since the movable clinchers can be rotated by the cam surfaces of the rotation cams, the rotation stroke amounts of the movable clinchers are free from the variations in the oscillation strokes of the drive links but can be restricted by the rotation of the rotation cams, which makes it possible to operate the movable clinchers in a given operation stroke.

Also, it is another object of the invention to provide a stapler including a staple leg cutting mechanism in which not only burrs to be formed in the leading end portions of staple legs when the staple legs are cut can be formed in a direction to prevent an operator's finger from touching the burrs but also the staple legs penetrated through binding sheets can be formed curved toward the surfaces of the binding sheets and thus can be clinched positively.

In attaining the above object, according to the invention, there is provided a stapler including a staple leg cutting mechanism structured such that a staple is struck out from a striking mechanism part toward binding sheets and the legs of the staple are penetrated through the binding sheets, the leading end portions of the staple legs penetrated through the binding sheets are cut by a staple leg cutting mechanism in such a manner that the lengths of the staple legs are substantially constant, and the staple legs with the leading end portions thereof cut are bent along the back surfaces of the binding sheets by a clincher mechanism, in which the staple leg cutting mechanism is composed of a fixed cutter interposed between the staple legs penetrated through the binding sheets and a pair of movable cutters disposed with respect to the fixed cutter so as to be movable from the outside of the staple legs toward the inside thereof, and the clincher mechanism is composed of a pair of movable clinchers respectively disposed on the lower surface side of the respective movable cutters, whereby, after the staple legs penetrated through the binding sheets to the back surface side thereof are engaged with the movable clinchers, the staple legs can be formed curved toward the inside thereof and can be guided to and between the movable cutters and fixed cutter; next, when the movable cutters are operated from the outside of the staple legs to the inside thereof, the leading end portions of the staple legs can be cut; and then, the staple legs with the leading end portions thereof cut can be bent along the binding sheets by the movable clinchers.

According to the invention, the staple leg cutting mechanism is composed of a fixed cutter interposed between staple legs penetrated through binding sheets and a pair of movable cutters respectively disposed on both sides of the fixed cutter such that they can be moved in the horizontal direction, and, by moving the movable cutters from the outside of the binding sheets to the inside thereof, the leading end portions of the staple legs can be cut. Thanks to this, in the staple-bound state, burrs to be formed in the cut surfaces of the staple legs can be formed directed toward the inside of the staple legs, that is, toward the sheet surface side of the binding sheets, and the binding sheets can be bound together in such a manner that the burrs formed on the leading end faces of the staple legs are closely contacted with the back surface side of the binding sheets. Thus, even when the hand of an operator touches the staple legs, the hand can be prevented from being contacted with the burrs, which eliminates a fear that the burrs formed by cutting the staple legs can injure the hand of the operator.

Further, since the pair of movable cutters of the staple leg cutting mechanism are operated in the horizontal direction and the pair of movable clinchers of the clincher mechanism are respectively disposed on the lower surface side of their associated movable cutters, the staple leg cutting mechanism and movable clinchers can be arranged on the same plane and thus the movable clinchers can be operated and rotated without moving the staple leg cutting mechanism, thereby being able to simplify the mechanisms. This makes it possible to reduce the sizes, weights and production costs of the mechanisms and thus the stapler. In addition, in a state where the staple legs penetrated through the binding sheets to the back surface side thereof are engaged with the movable clinchers, the staple legs are formed curved toward the inside of the staple legs, and then the staple legs are guided to and between the movable cutters and fixed cutter. Thanks to this, the leading end portions of the staple legs penetrated through the binding sheets can be formed curved toward the surfaces of the binding sheets, which makes it possible to clinch the staple legs positively.

BRIEF DESCRIPTION OF THE DRAWINGS

FIG. 10(*b*) is a longitudinal front view of the main portions of the clincher mechanism, showing the operation state of the clincher mechanism, specifically showing a state just before movable clinchers are operated and rotated.

FIG. 10(*c*) is a longitudinal front view of the main portions of the clincher mechanism, showing the operation state of the clincher mechanism, specifically showing a state in which the clinching operation of the staple legs by the movable clinchers is completed.

FIG. 10(*d*) is a is a longitudinal front view of the main portions of the clincher mechanism, showing the operation state of the clincher mechanism, specifically showing a state in which, after the clinching operation of the staple legs by the movable clincher is completed, the drive links are further operated.

DESCRIPTION OF THE REFERENCE NUMERALS

Figure 1:
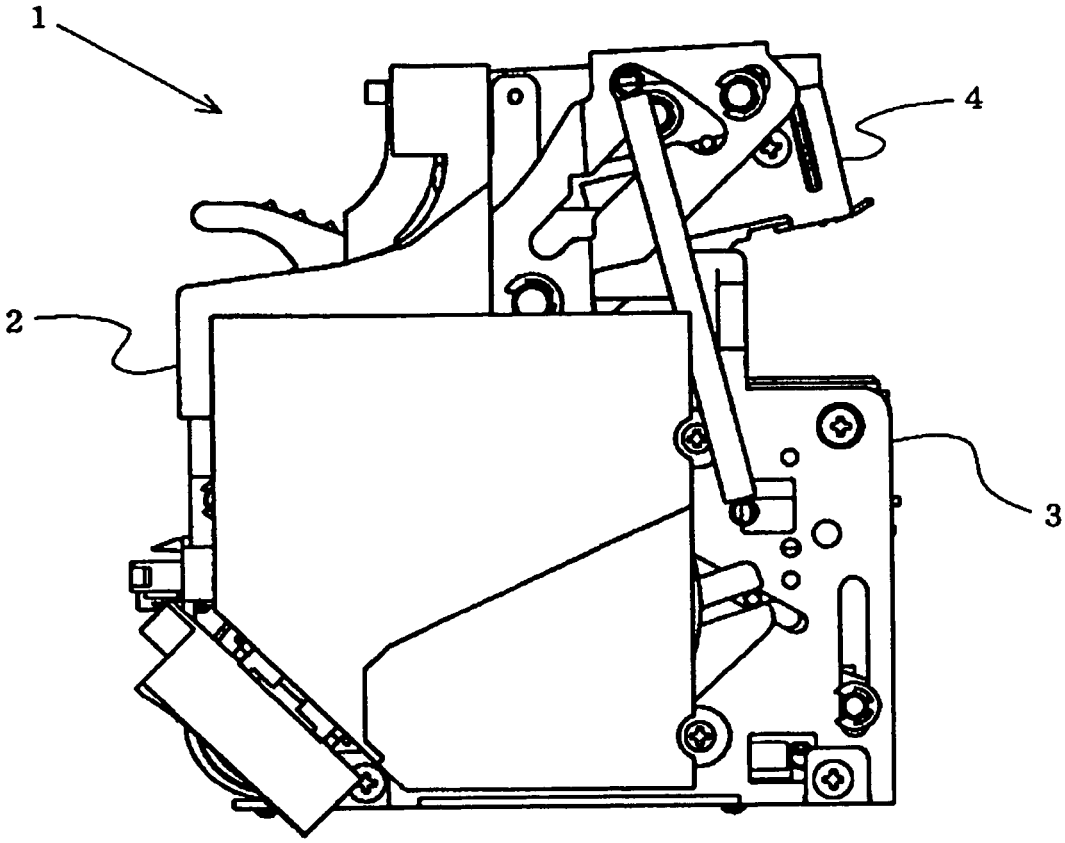
FIG. 1 is a side view of a stapler incorporating therein a staple leg cutting mechanism according to the invention.

By the way, in the drawings, reference character 1 designates a stapler, 5 a staple leg cutting mechanism, 6 a fixed cutter, 7 a movable cutter, 10 a clincher mechanism, 11 a movable clincher, 15 a cutter cam, 16 a clincher cam, and 18 a drive link, respectively.

BEST MODE FOR CARRYING OUT THE INVENTION

Now, description will be given below of embodiments of the invention.

Embodiment 1

Figure 13:
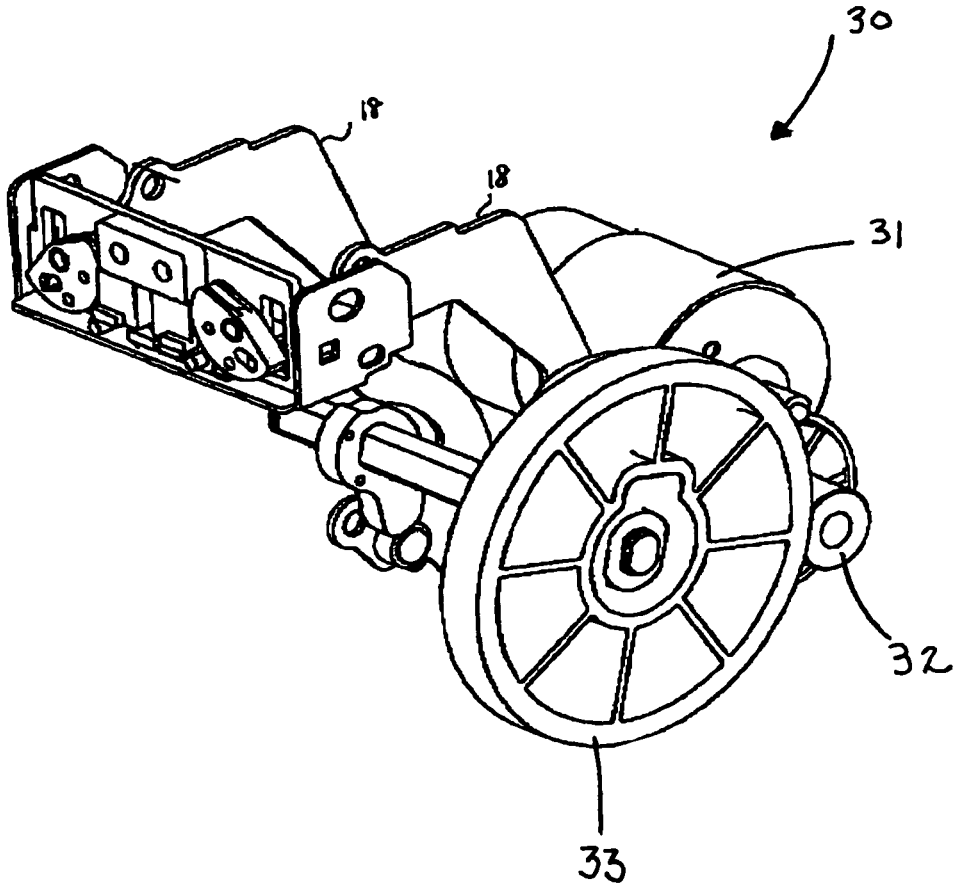
FIG. 13 is a perspective view of the drive mechanism showing an electric motor.

FIG. 1 shows a stapler according to an embodiment of the invention. In a stapler frame 2 forming the outline of the present stapler 1, there are stored an electric motor 31 and a drive mechanism 30. See FIG. 13 for the drive mechanism 30 and the electric motor 31. Also, in the lower portion of the stapler frame 2, there is disposed a striking mechanism part 3 which can be driven by the drive mechanism 30 to thereby strike out a U-shaped staple toward binding sheets. The striking mechanism part 3 according to the present embodiment is structured such that not only it can form a large number of mutually connected straight-shaped staple materials into a U-shaped staple using forming means but also it can strike out the thus-formed staple in an upward facing manner toward binding sheets disposed upwardly of the striking mechanism part 3.

Figure 2:
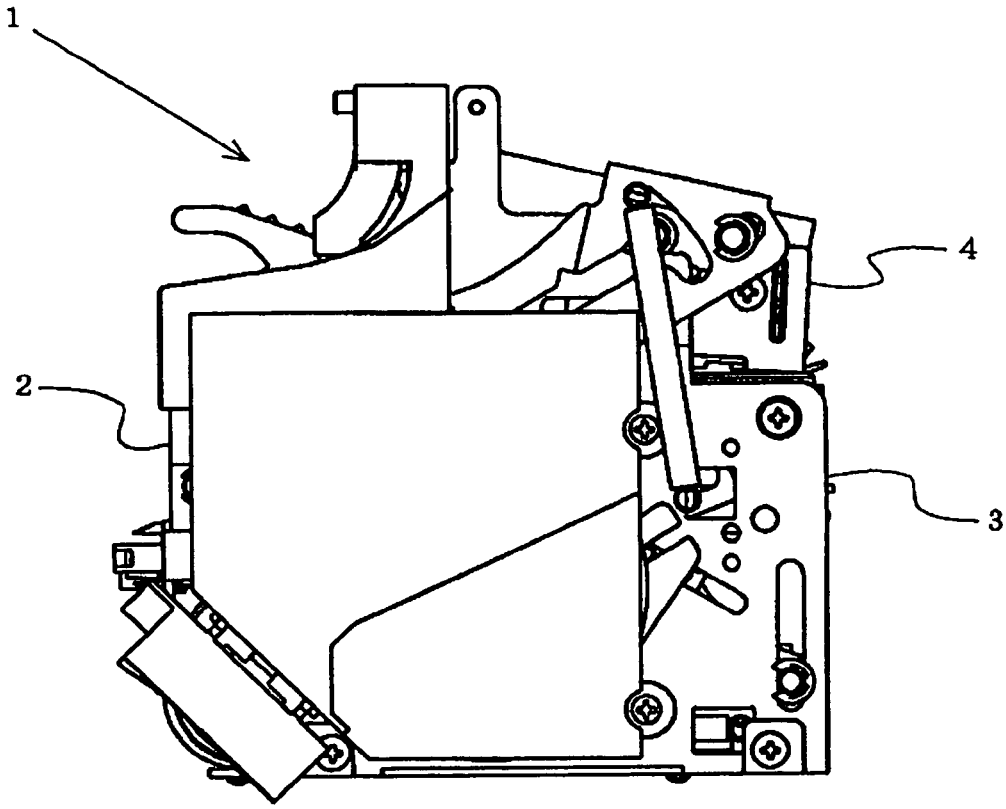
FIG. 2 is a side view of the same stapler as shown in FIG. 1, showing a state in which a clincher mechanism is in operation.

Further, in the upper portion of the stapler frame 2 that is opposed to the striking mechanism part 3, there is formed a clincher mechanism 4 which is used to bend the legs of staples penetrated through the binding sheets to the upper side thereof along the upper surfaces of the binding sheets. The clincher mechanism 4 is supported on the stapler frame 2 in such a manner that the leading end portion thereof can be rotated in approaching and parting directions with respect to the striking mechanism part 3 and, in the normal state thereof, the clincher mechanism part 4 is disposed apart from the striking mechanism part 3. After the binding sheets are interposed between the striking mechanism part 3 and clincher mechanism part 4, as shown in FIG. 2, the clincher mechanism part 4 is operated and rotated in such a manner that the binding sheets can be held by and between the striking mechanism part 3 and clincher mechanism part 4. After the clincher mechanism part 4 is operated and rotated in the direction of the striking mechanism part 3, the staple is struck out from the striking mechanism part 3 toward the binding sheets.

In the clincher mechanism part 4, there are formed a staple leg cutting mechanism 5 which cuts the legs of staples struck out from the striking mechanism part 3 and penetrated through the binding sheets so as to make even the lengths of the staple legs, and a clincher mechanism 10 used to bend the staple legs, the lengths of which have been cut even by the staple leg cutting mechanism 5, along the upper surfaces of the binding sheets.

The clincher mechanism 10 is composed of a pair of L-shaped movable clinchers 11 each of which is supported on its associated rotation shaft 14 in such a manner that it can be rotated with respect to a support plate 8. Each of the movable clinchers 11 is formed of a clincher piece 12 and an operation piece 13. The clincher piece 12 can be engaged with the staple legs respectively penetrated through the binding sheets and projected out to the back surface side of the binding sheets and also can bend its associated staple leg toward the inside thereof; and, the operation piece 13 is disposed so as to extend from the clincher piece 12 in a direction substantially perpendicular to the clincher piece 12.

The staple leg cutting mechanism 5 is composed of a fixed cutter 6 interposed between a pair of staple legs penetrated through the binding sheets and projected out to the upper surface side of the binding sheets, and a pair of movable cutters 7 disposed in close contact with the upper surface of the fixed cutter 6 and supported such that they can be operated from the outside of the staple legs toward the inside thereof. In the staple leg cutting mechanism 5, by operating the staple legs interposed between the two side edges of the fixed cutter 6 and the pair of movable cutters 7 so as to move from the outside of the staple legs toward the inside thereof, the leading end portions of the staple legs can be cut to a given length between the cutting edges of the fixed cutter 6 on both sides thereof. Since the leading end portions of the staple legs are cut by moving the two movable cutters 7 from the outside of the staple legs to the inside thereof, the direction of burrs formed on the cut end faces of the cut staple legs is formed directed toward the inside of the two staple legs. Thus, in a state where the binding sheets are bound by the staples, the burrs are arranged in a direction where they can be closely contacted with the binding sheets.

Figure 3:
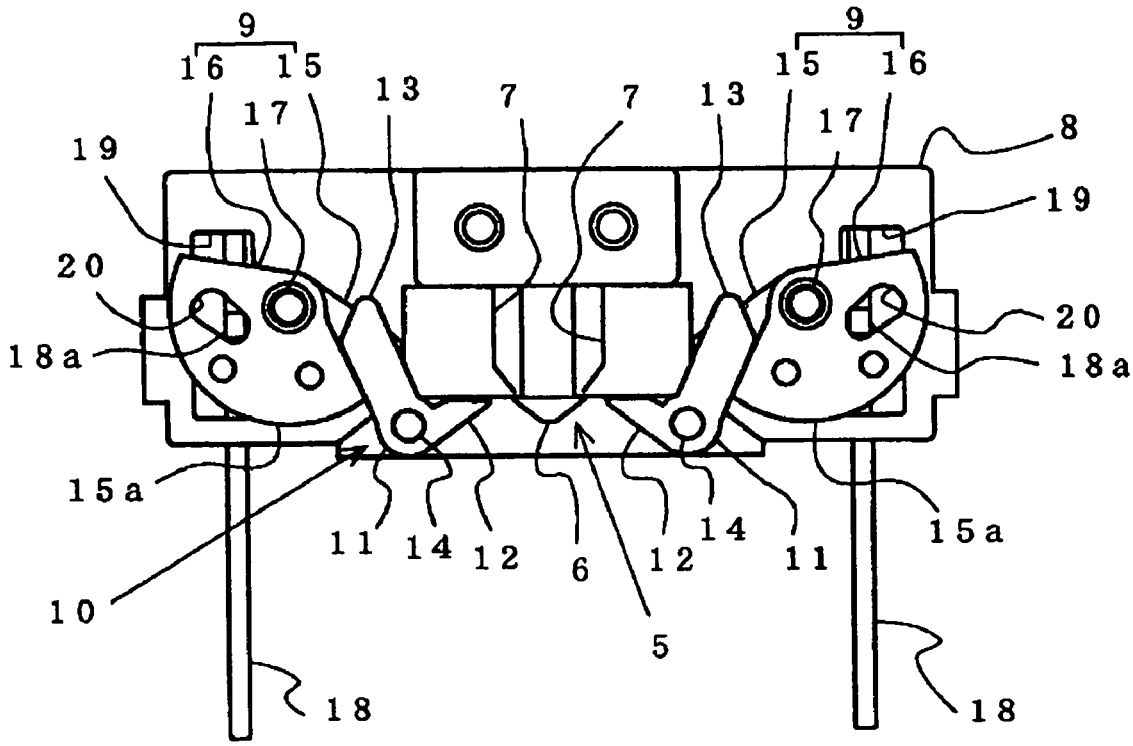
FIG. 3 is a front view of a staple leg cutting mechanism and a clincher mechanism respectively formed in a clincher mechanism part.
Figure 4:
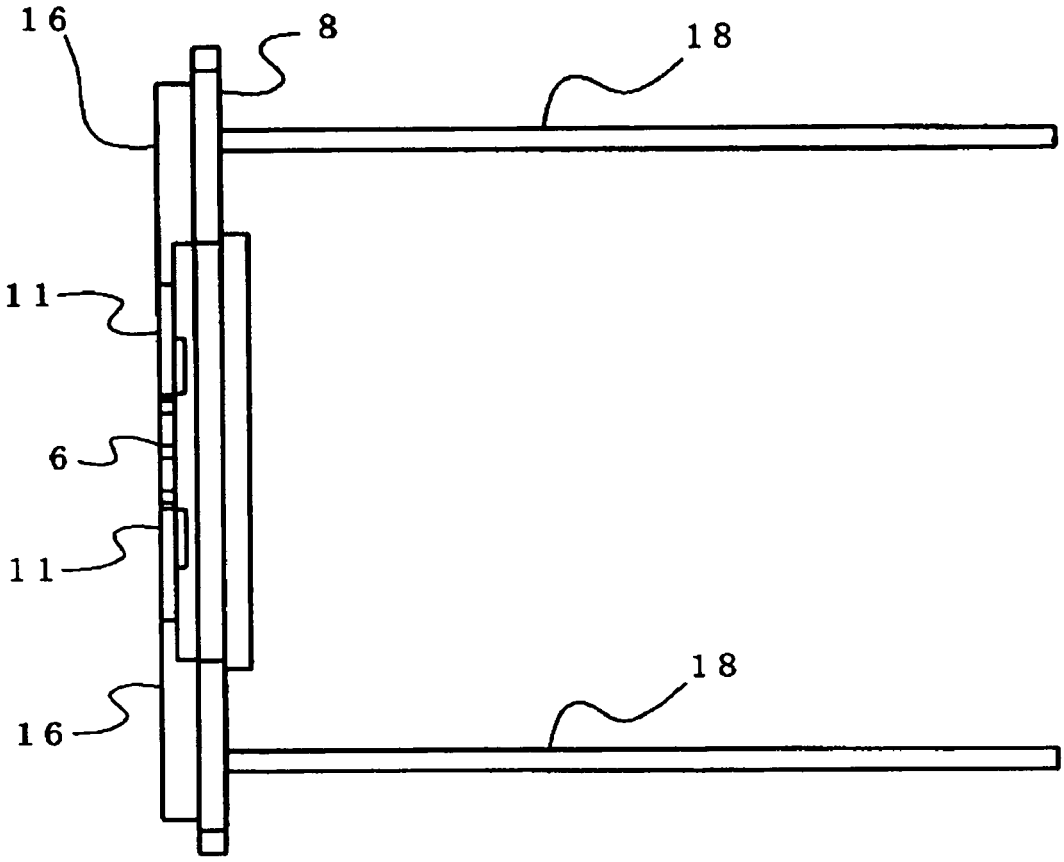
FIG. 4 is a plan view of the same staple leg cutting mechanism and clincher mechanism as shown in FIG. 3.

As shown in FIG. 3, each of the movable clinchers 11 is supported in such a manner that, in a state where the clincher mechanism 10 is not in operation, the clincher piece 12 of each movable clincher 11 is disposed in an inclined manner at a position opposed to the leading end portion of the staple leg of the staple struck out from the striking mechanism 3 toward the binding sheets. When the leading end portions of the staple legs struck out from the striking mechanism 3 and penetrated through the binding sheets are engaged with the inclined clincher pieces 12, the leading end portions of the paired staple legs can be guided in their mutual inside directions and can be further guided to and between the side edges of the fixed cutter 6 and the movable cutters 7 while the staple legs are being curved. After the movable cutters 7 of the staple leg cutting mechanism 5 are slidingly moved from the outside of the staple legs to the inside thereof to thereby cut the leading end portions of the staple legs, the movable clinchers 11 are rotated to thereby bend the curved-formed staple legs by the clincher pieces 12 along the back surfaces of the binding sheets.

Figure 5:
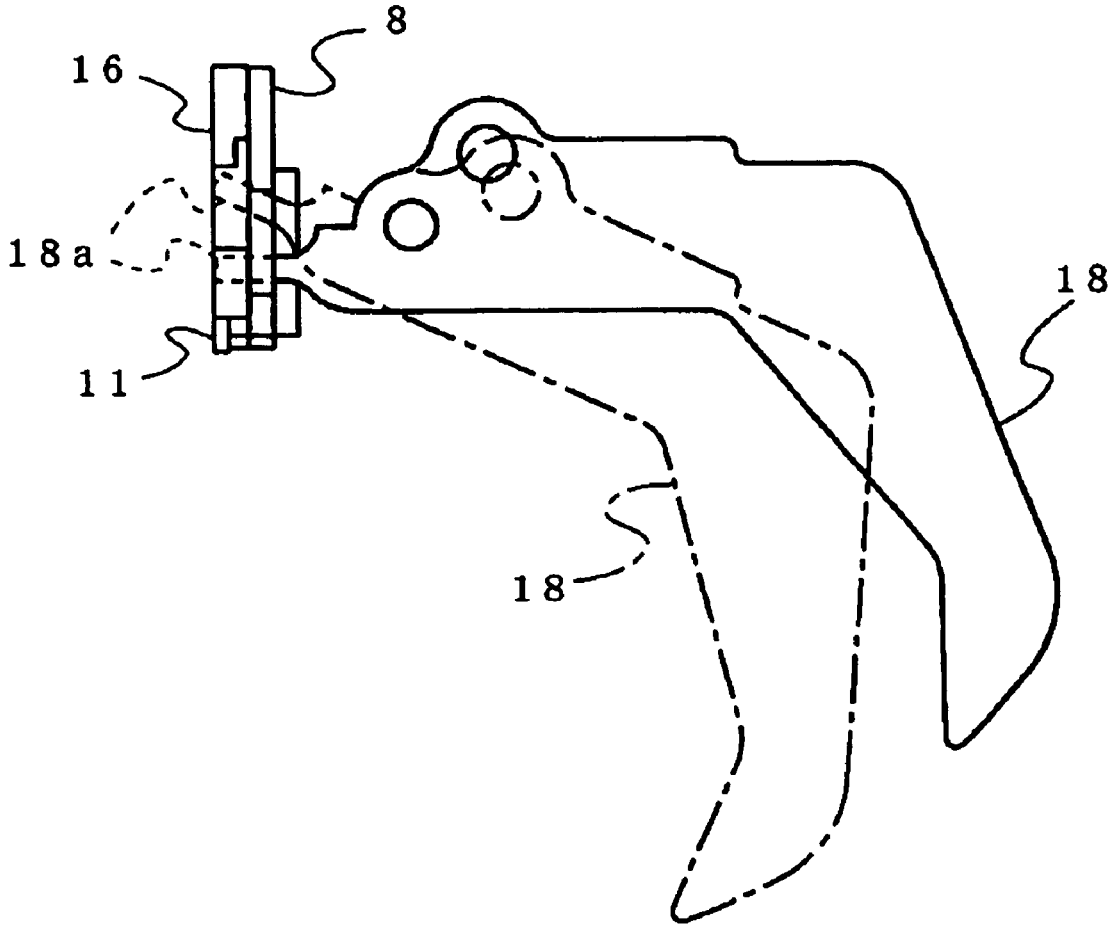
FIG. 5 is a side view of the same staple leg cutting mechanism and clincher mechanism as shown in FIG. 3.
Figure 6:
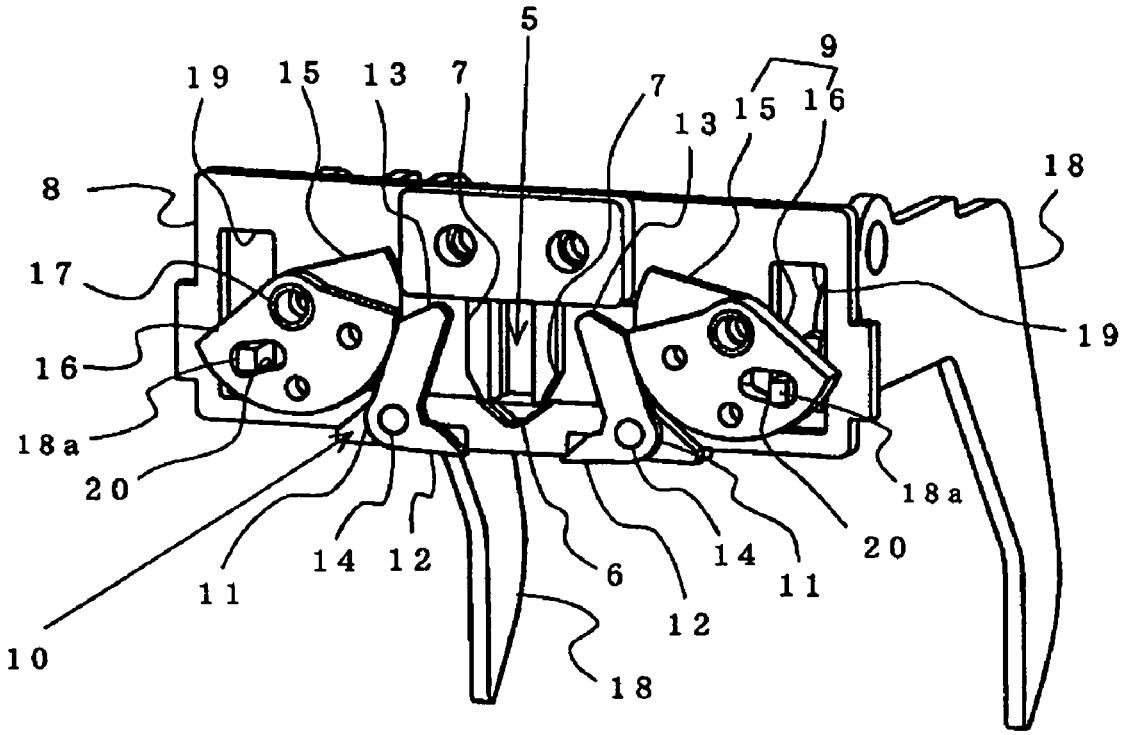
FIG. 6 is a perspective view of the staple leg cutting mechanism and clincher mechanism, showing in a state where they are in operation.

In the support plate 8, there are formed rotation cams 9 which are used to rotate their associated movable cutters 7 and movable clinchers 11. Each of the rotation cams 9 is composed of a cutter cam 15 and a clincher cam 16 which are formed as an integral body. The cutter cam 15 can be engaged with the side surface of its associated movable cutter 7 to thereby drive and slide the movable cutter 7, and a clincher cam 16 can be engaged with the operation piece 13 of the movable clincher 11 to thereby operate and rotate the movable clincher 11. The rotation cam 9 is supported on the support plate 8 by a rotation support shaft 17 in such a manner that the cutter cam 15 and clincher cam 16 can be rotated integrally. The cams 15 and 16 respectively have arc-shaped cam surfaces 15*a* and 16*a* formed on the outer peripheral surfaces thereof, while the arc-shaped cam surfaces 15*a* and 16*a* are respectively disposed so as to face the movable cutter 7 and the operation piece 13 of the movable clincher 11. Thus, when the cams are rotated, the movable cutter 7 and movable clincher 11 can be operated. The cutter cam 15 and clincher cam 16 are combined as an integral body so that they can be rotated integrally. As shown in FIG. 5, the cutter and clincher cams 15 and 16 can be driven and rotated by a drive link 18 the lower portion of which can be operated and oscillated by a drive mechanism 30 for driving the stapler 1.

The leading end portions 18*a* of the drive links 18 are respectively projected on the front side of the support plate 8 through their associated openings 19 respectively formed in the support plate 8 and are loosely fitted into their associated openings 20 respectively formed in the cutter and clincher cams 15, 16. And, when the leading end portions 18*a* of the drive links 18 are operated and oscillated in the vertical direction, the clincher cam 16 and cutter cam 15 can be integrally rotated about their respective rotation support shafts 17, so that the staple leg cutting mechanism 5 and clincher mechanism 10 can be driven by their associated arc-shaped cam surfaces 15*a*, 16*a* respectively formed on the cutter and clincher cams 15, 16. As described above, the cutter and clincher cams 15 and 16 are combined as an integral body and can be rotated integrally with each other; however, due to provision of a difference in phase between the cutter and clincher cams 15 and 16, the operation timings of the movable cutter 7 to be operated and slided by the cutter cam 15 and the movable clincher 11 to be operated and rotated by the clincher cam 16 are set independent of each other.

Figure 7:
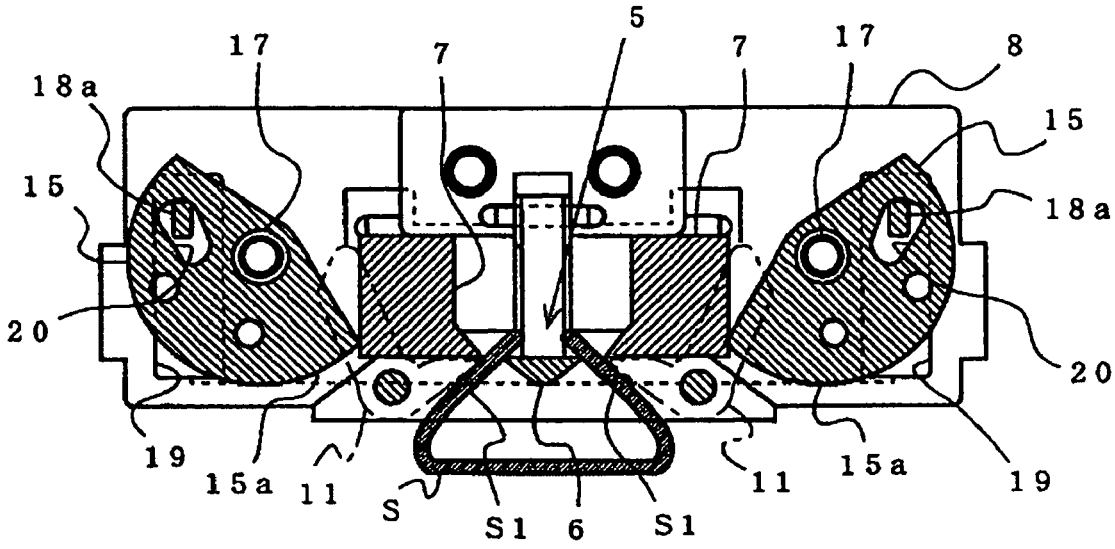
FIG. 7 is a longitudinal section view of the staple leg cutting mechanism, showing a state before it is operated.

As shown in FIG. 7, in a state where the drive link 18 is not in operation, the leading end portion 18*a* of the drive link 18 is disposed in its upper position. Therefore, the cutter cam 15 and clincher cam 16, which are disposed on the left side in the drawing, are situated in the positions where they have been rotated clockwise about the rotation support shaft 17; whereas the cutter cam 15 and clincher cam 16, which are disposed on the right side, are situated in the positions where they have been rotated counterclockwise about the rotation support shaft 17. And, the movable cutters 7 are respectively disposed in positions where they are have been retreated in the outside direction of the staple legs S1 of the staple S, while the clincher pieces 12 of the movable clinchers 11 are disposed inclined and opposed to the striking position of the staple S. The cutter and clincher cams 15 and 16 are not rotated until the staple legs S1 of the staple S struck out from the striking mechanism part 3 toward the binding sheets are penetrated through the binding sheets and the leading end portions of the staple legs S1 are guided by the clincher pieces 12 and are thereby inserted into and between the fixed cutter 6 and movable cutters 7.

Figure 8:
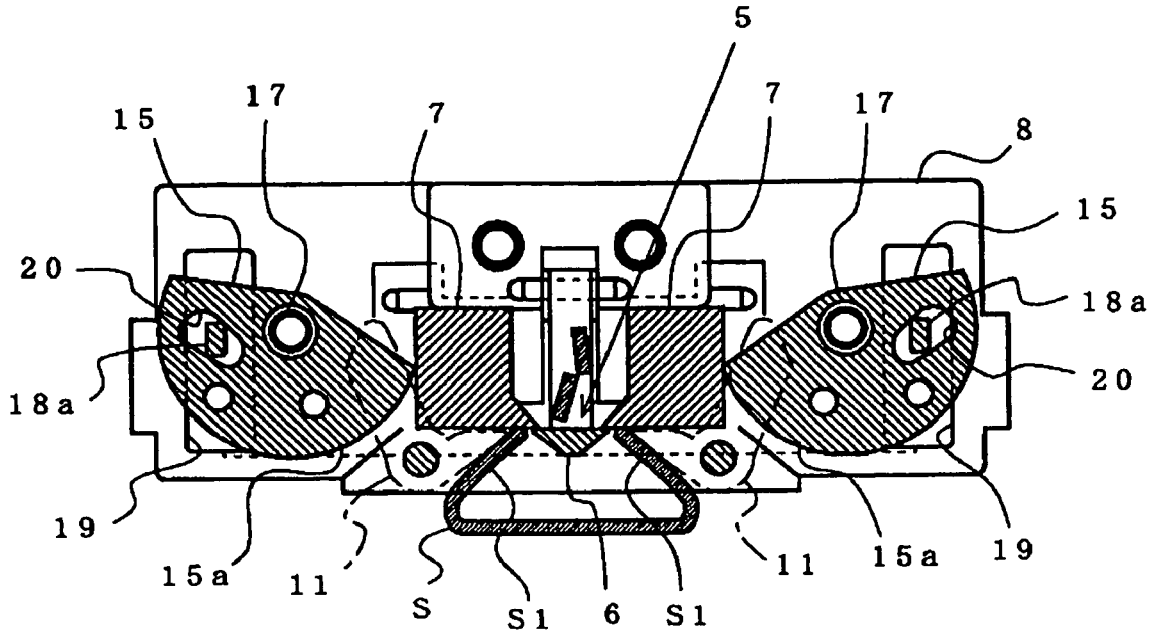
FIG. 8 is a longitudinal front view of the staple leg cutting mechanism, showing a state where movable cutters are operated and stifled slid by cutter cams.
Figure 11:
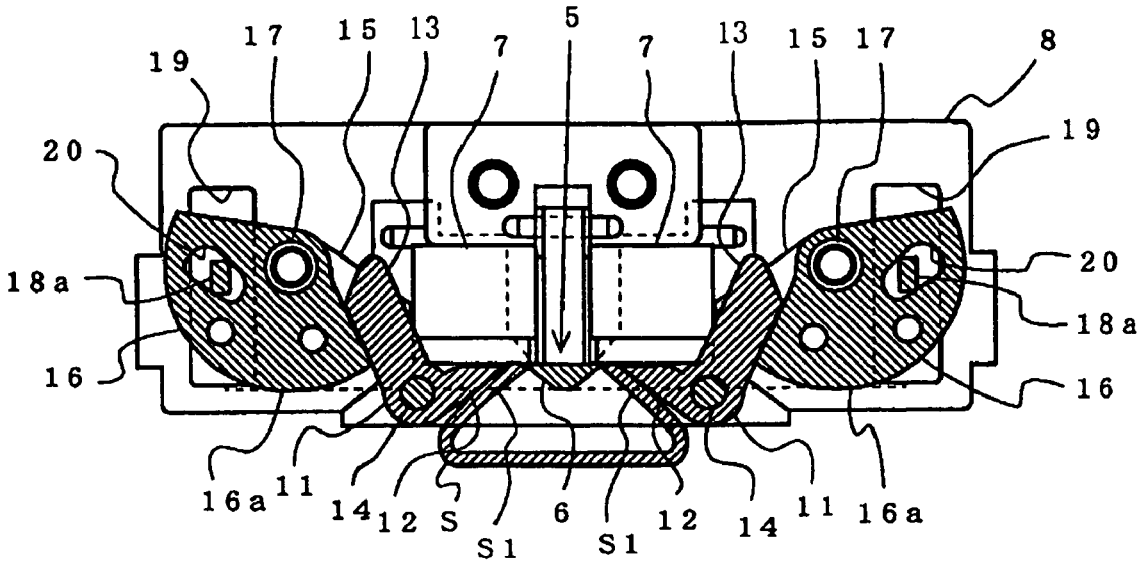
FIG. 11 is a longitudinal front view of the clincher mechanism, showing a state before it is operated.

After the staple legs S1 of the staple S struck out from the striking mechanism part 3 and penetrated through the binding sheets are guided by the clincher pieces 12 and are thus inserted into and between the fixed cutter 6 and movable cutters 7, the drive links 18 are operated by the drive mechanism 30 and thus the leading end portions 18*a* of the drive links 18 are operated and oscillated downward, thereby operating and rotating the cutter and clincher cams 15 and 16 disposed on the left side of the drawing counterclockwise as well as the cutter and clincher cams 15 and 16 on the right side clockwise. As shown in FIG. 8, when the leading end portions 18*a* of the drive links 18 are operated substantially up to their respective intermediate positions, the movable cutters 7 are respectively operated and slid by the arc-shaped cam surfaces 15*a* of their respective cutter cams 15, whereby the leading end portions of the staple legs S1 interposed between the fixed cutter 6 and movable cutters 7 are cut. At the then time, as shown in FIG. 11, the clincher cams 16 are not yet engaged with the operation pieces 13 of their respective movable clinchers 11 and, therefore, the movable clinchers 11 are not operated yet.

Figure 9:
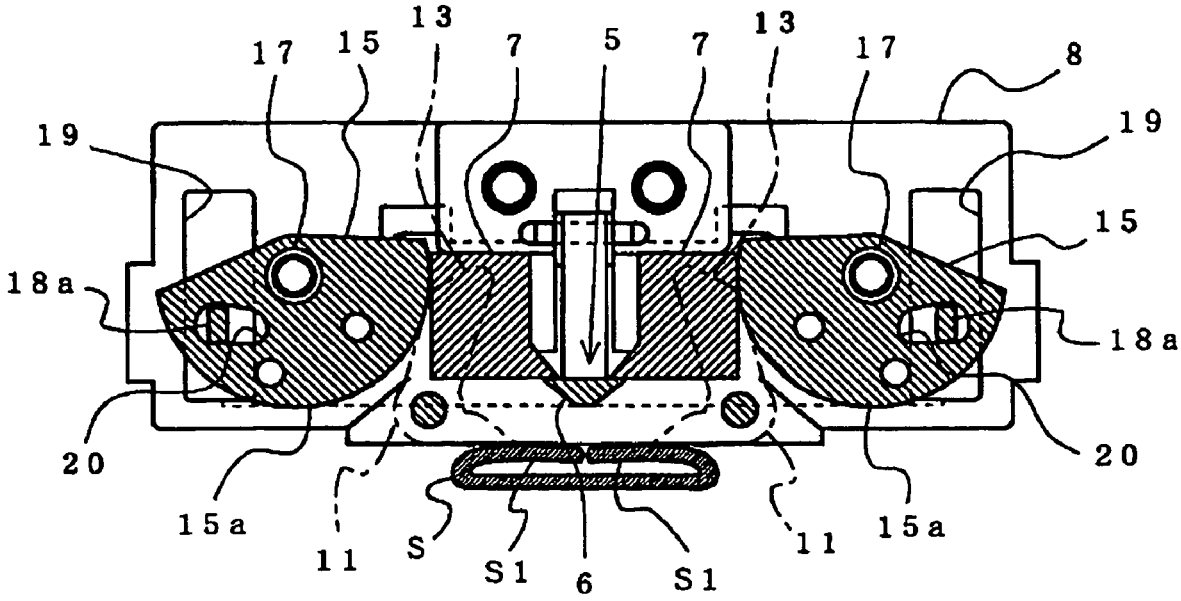
FIG. 9 is a longitudinal front view of the staple leg cutting mechanism, showing a state where the movable cutters are held at their sliding operation positions.
Figure 10A:
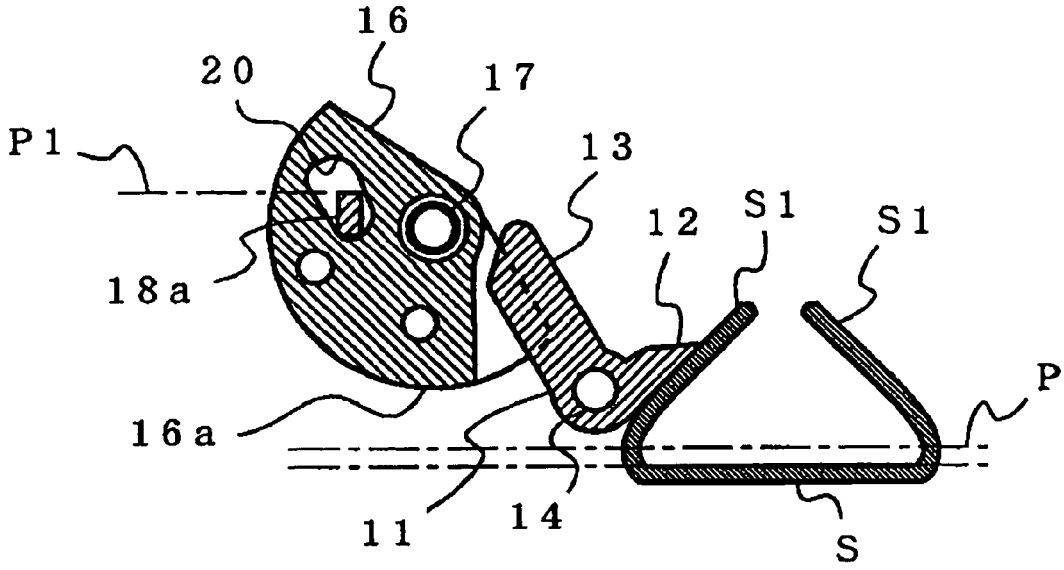
FIG. 10(*a*) is a longitudinal front view of the main portions of the clincher mechanism, showing the operation state of the clincher mechanism, specifically, showing a state before drive links are operated.
Figure 10B:
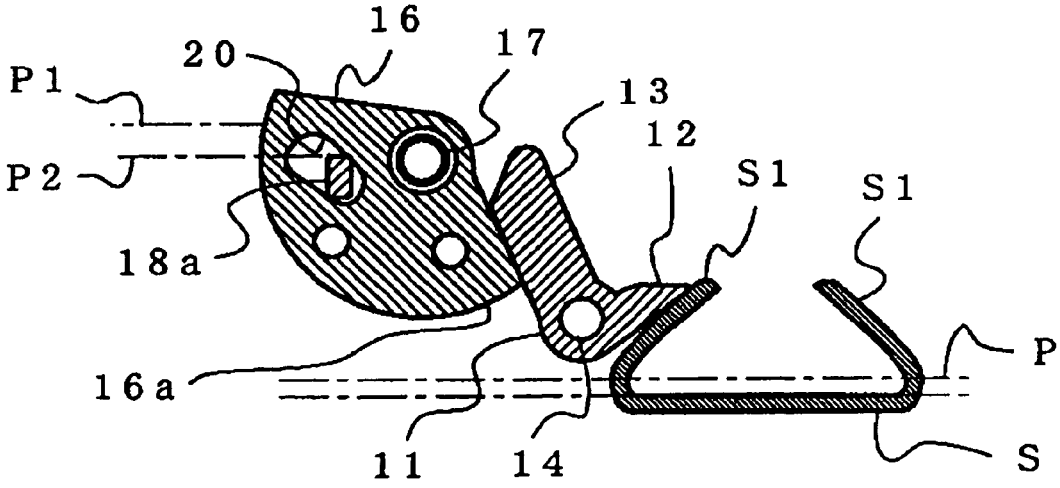
Figure 10C:
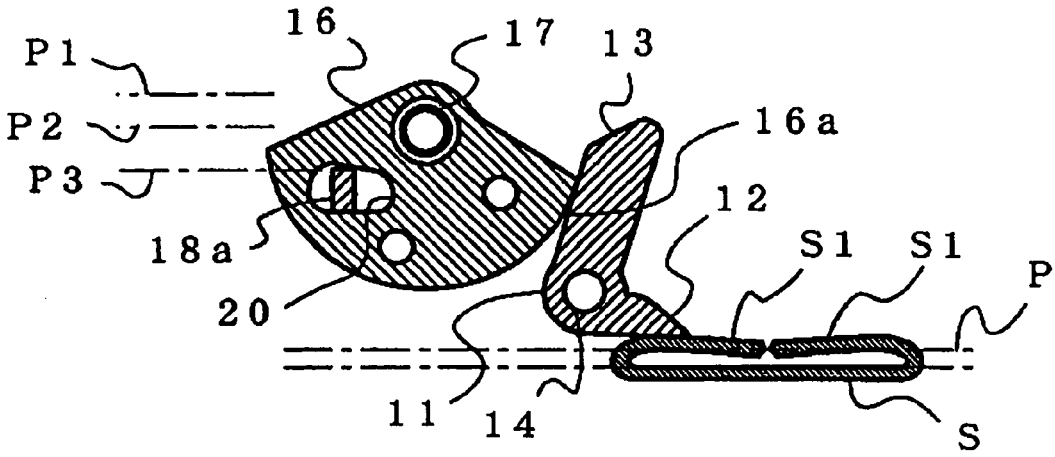
Figure 10D:
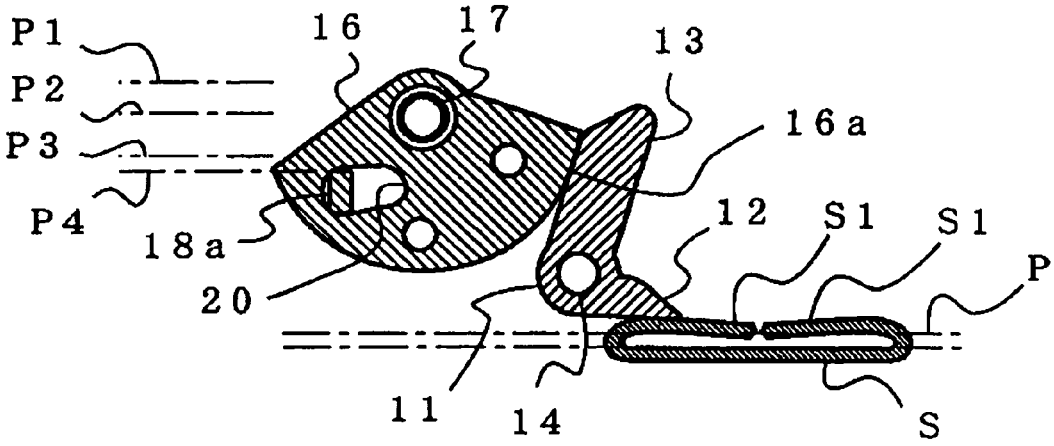
Figure 12:
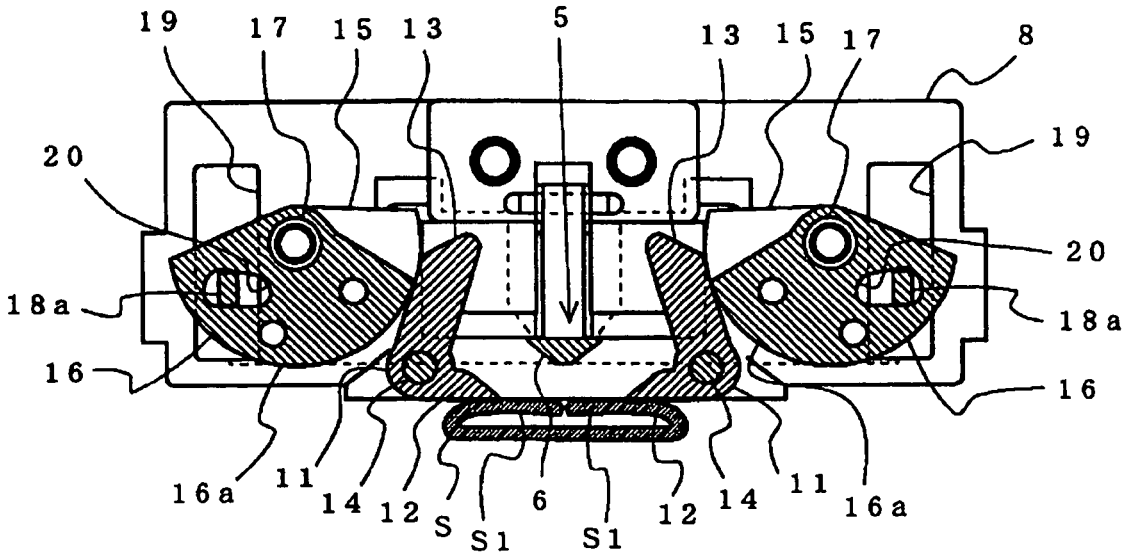
FIG. 12 is a longitudinal front view of the clincher mechanism, showing a clinching state in which the movable clinchers are rotated by clincher cams.

As shown in FIG. 9, when the drive links 18 are operated and thus the leading end portions 18*a* thereof are operated down to their bottom dead center positions, the movable cutters 7 are held at their respective slided positions where the staple legs S1 have been cut by the arc-shaped cam surfaces 15*a* of the cutter cams 15, thereby being able to prevent cutoffs cut apart from the staple legs S1 from dropping down in the direction of the binding sheets. Further, at the then time, as shown in FIG. 12, the clincher cams 16 are respectively engaged with the operation pieces 13 of their associated movable clinchers 11 and are thus pressed against the operation pieces 13, whereby the movable clincher 11 on the left side is rotated clockwise, while the movable clincher 11 on the right is rotated counterclockwise. Thus, the clincher pieces 12 of the movable clinchers 11 are pressed against the staple legs S1 to pressure contact the staple legs S1 to the back surfaces of the binding sheets, thereby clinching the staple legs S1.

The cutter cam 15 and clincher cam 16 respectively include arc-shaped cam surfaces 15*a* and 16*a* which are respectively set to have given radius dimensions from the centers of their respective rotation support shafts 17 supporting their respective cams 15 and 16 rotatably, while the radius dimensions of the arc-shaped cam surfaces 15*a* and 16*a* of the cams 15 and 16 are set to be identical with the slide stroke amount of the movable cutter 7 and the rotation stroke amount of the movable clincher 11. And, the rotation stroke amounts of the cams 15 and 15 are set larger than the slide stroke amount of the movable cutter 7 and the rotation stroke amount of the movable clincher 11. In this manner, since the arc-shaped cam surfaces 15*a* and 16*a* are formed of arc surfaces having given radius dimensions from the centers of the rotation support shafts 17, and also since the rotation stroke amounts of the cams 15 and 16 are set larger than the slide stroke amount of the movable cutter 7 and the rotation stroke amount of the movable clincher 11 so that the cams 15 and 16 can be rotated more than the movable cutter 7 and the movable clincher 11, the slide stroke amount of the movable cutter 7 and the rotation stroke amount of the movable clincher 11 can be regulated by the rotation cam 9, so that the movable clincher 11 can be positively operated up to a given position with a given operation stroke regardless of variations in the oscillation stroke amount of the drive link 18.

Now, description will be given below of the operation state of the movable clincher 11 to be executed by one clincher cam 16 with reference to FIGS. 10(*a*)-10(*d*). As shown in FIG. 10(*a*), in a state where the drive link 18 is not in operation, the leading end portion 18*a* of the drive link 18 is disposed at the top dead center position P1, whereby the clincher cam 16 is rotated clockwise and thus the arc-shaped cam surface 16*a* thereof is thus disposed at a position apart from the operation piece 13 of the movable clincher 11. Owing to this, the clincher pieces 12 of the movable clinchers 11 are disposed inclined and opposed to the striking position of the staple S. When the drive links 18 are operated and oscillated downward from the top dead center position P1, the clincher cams 16 are rotated counterclockwise integrally with their associated cutter cams 15 and, at the time, as described above, the movable cutters 7 are operated and slided by the cutter cams 15, thereby cutting the leading end portions of the staple legs S1.

As shown in FIG. 10(*b*), when the leading end portions 18*a* of the drive links 18 are operated and oscillated further downward from the top dead center position P1 to thereby rotate the clincher cams 16 further counterclockwise and the leading end portions 18*a* of the drive links 18 are operated downward from the top dead center position P1 to the position P2 existing slightly downwardly of the position P1, the end edges of the arc-shaped cam surfaces 16*a* of the clincher cams 16 are engaged with the operation pieces 13 of the movable clinchers 11 to thereby operate and rotate the movable clinchers 11 clockwise about the rotation shafts 14, so that the staple legs S1 are bent in the direction of the back surfaces of the binding sheets P by the clincher pieces 12.

Further, when the leading end portions 18*a* of the drive links 18 are operated and oscillated further downward to thereby rotate the clincher cams 16 further and thus, as shown in FIG. 10(*c*), the leading end portions 18*a* of the drive links 18 are moved down to a position P3, the arc-shaped cam surfaces 16*a* of the clincher cams 16 are respectively engaged with their associated back surfaces of the operation pieces 13 of the movable clinchers 11. That is, the states of the movable clinchers 11 rotated in this manner by the arc-shaped cam surfaces 16*a* of the clincher cams 16 respectively provide the final rotation positions of the respective movable clinchers 11. In these positions, the staple legs S1 are respectively clinched along the back surfaces of the binding sheets P by the clincher pieces 12 of the movable clinchers 11.

Even after the staple legs S1 are clinched by the movable clinchers 11, the drive links 18 are further operated and oscillated and thus, as shown in FIG. 10(*d*), the leading end portions 18*a* of the drive links 18 are operated and moved down to the bottom dead center position P4. Owing to such downward operation of the leading end portions 18*a*, the clincher cams 16 are also operated and rotated counterclockwise further. However, since the arc-shaped cam surfaces 16*a* respectively formed as arc-shaped surfaces extending from the rotation support shafts 17 of the clincher cams 16 so as to have the same radius are engaged with the operation pieces 13 of the movable clinchers 11, the movable clinchers 11 are prevented from being rotated any further, thereby being able to maintain the clinched state of the staple legs S1 by the clincher pieces 12. That is, when the clincher cams 16 are rotated from the position shown in FIG. 10(*b*) to the position shown in FIG. 10(*c*), the movable clinchers 11 are operated and rotated to thereby clinch the staple legs S1; but, the movable clinchers 11 cannot be operated by the rotation of the leading end portions 18*a* of the drive links 18 from the top dead center position P1 to the bottom dead center position P2 and the rotation of the clincher cams 16 from the P3 position to the bottom dead center position P4. Therefore, even when the oscillation ranges of the drive links 18 vary, there is no possibility that the clinching operation of the movable clinchers 11 can be influenced by such variations in the oscillation ranges of the drive links 18.

Although the invention has been described heretofore in detail with reference to the specific embodiments, it is obvious to persons skilled in the art that various changes and modifications are also possible without departing from the spirit and scope of the invention.

The present patent application is based on the Japanese Patent Application (JP 20004-005239 application) and the Japanese Patent Application (JP 20004-005240 application) respectively filed on Jan. 13, 2004, and thus the contents of these applications are incorporated into the present patent application.

INDUSTRIAL APPLICABILITY

According to the above-mentioned embodiments of the invention, in each of the clincher cams 16, there is formed the arc-shaped cam surface 16*a* having a given radius with the rotation support shaft of the clincher cam 16 as the center thereof, and also the rotation stroke amounts of the clincher cams 16 to be rotated by the drive links 18 are set larger than the rotation stroke amounts of the movable clinchers 11. Thanks to this, the movable clinchers 11, which have been operated a given rotation stroke amount by the end edges of the arc-shaped cam surfaces 16*a*, can be held at their respective operation positions by their associated arc-shaped cam surfaces 16*a*, whereby the operation stroke amounts and stroke ranges of the movable clinchers 11 can be always maintained constant regardless of the variations in the oscillation stroke amounts of the drive links 18. This can stabilize the operations of the movable clinchers 11 to bend the staple legs S1 along the back surfaces of the binding sheets P, thereby being able to eliminate the possibility that the staple legs S1 can be pressed more than necessary by the clincher pieces 12, or the possibility that the staple legs S1 can be clinched in such a manner that they can float up from the back surfaces of the binding sheets due to the shortage of the pressing amounts of the clincher pieces 12 against the staple legs S1.

Also, the staple leg cutting mechanism 5 is composed of the fixed cutter 6 disposed inside the staple legs S1 and the paired movable cutters 7 disposed so as to be operated from the outside of the staple legs S1 toward the inside thereof, whereby the movable cutters 7 can be operated and slided from the outside of the staple legs S1 toward the inside thereof to thereby cut the leading end portions of the staple legs S1. Thanks to this, the directions of burrs formed on the cut surfaces of the staple legs S1 are formed on the inside edges of the cut surfaces of the staple legs S1, which makes it possible to clinch the staple legs S1 in such a manner that the burrs are allowed to face the surfaces of the binding sheets. Therefore, when the staple-bound sheets are piled up on top of one another, there is eliminated the occurrence of problems in quality such as a problem that a scratch trace is left on the piled-up sheets due to the burrs formed on the staple legs S1.

Further, the clincher pieces 12 of the movable clinchers 11 are disposed inclined so as to correspond to the striking position of the staple S; the staple legs S1 penetrated through the binding sheets can be engaged with the clincher pieces 12 and thus the staple legs S1 can be curled such that they are curved toward the inward directions of the staple legs S1; and, in this state, the staple legs S1 are bent along the back surfaces of the binding sheets by the clincher pieces 12. Owing to this, the staple legs S1 can be clinched in such a manner that the leading end portions of the staple legs S1 are closely contacted with the back surfaces of the binding sheets. This prevents the leading end portions of the staple legs S1 from floating up from the surfaces of the binding sheets. Thus, when the staple-bound sheets are piled up on top of one another, it is possible to prevent the occurrence of problems in quality such as a problem that a scratch trace is left on the surfaces of the piled-up binding sheets due to the leading end portions of the staple legs S1.

In addition, the staple leg cutting mechanism 5 and clincher mechanism 10 can be formed on the same surface to which the staple legs S1 are struck out, and the movable clinchers 11 of the clincher mechanism 10 can be operated and rotated without retreating the fixed cutter 6 and movable cutters 7 of the staple leg cutting mechanism 5 from the above-mentioned same surface. This makes it possible to simplify these mechanisms, thereby being able to reduce the sizes, weights and production costs thereof. Also, the movable cutters 7 are disposed in close contact with the fixed cutter 6 arranged inside the staple legs S1, and the movable cutters 7 are slided and moved on the fixed cutter 6 to thereby cut the staple legs S1. Thanks to this, not only the setting and maintenance of a clearance between the fixed and movable cutters 6 and 7 can be facilitated but also the burrs to be formed can be reduced in size and quantity as much as possible.

The invention claimed is:

1. A stapler comprising:

a movable clincher including a clincher piece disposed so as to be engageable with staple legs penetrated through binding sheets to a back surface side of the binding sheets, the clincher piece being disposed so as to be opposed to a striking position of a staple and to be rotatable;

a clincher cam rotatable about a shaft including a cam surface directly engageable with the movable clincher so as to rotate the movable clincher, the clincher cam being driven through a drive link directly operated by a drive mechanism for driving a staple into the binding sheets;

a fixed cutter interposed between the staple legs penetrated through the binding sheets; and a movable cutter disposed so as to be movable with respect to the fixed cutter from the outside of the staple legs toward the inside thereof, wherein the staple legs penetrated through the binding sheets are guided into and between the movable cutter and fixed cutter, while the staple legs are engaged with movable clincher;

the leading end portions of the staple legs are cut due to the movement of the movable cutter from the outside of the staple legs toward the inside thereof; and the movable clincher bends the staple legs with the leading end portions thereof cut along the back surfaces of the binding sheets;

a cutter cam engageable with the movable cutter and capable of driving the movable cutter, wherein the clincher cam and the cutter cam are connected together as an integral body so that they can be rotated about the shaft with each other.

2. The stapler according to claim 1, wherein the cam surface includes an arc-shaped part formed so as to have the same radius from the center of rotation of the clincher cam.

* * * * *